US006765478B2

(12) United States Patent
Zhurin

(10) Patent No.: US 6,765,478 B2
(45) Date of Patent: Jul. 20, 2004

(54) CAP-SIGNALING DEVICE

(76) Inventor: Dmitry Vyacheslavovich Zhurin, Vernadsky prospect, 113, 9., Moscow (RU), 117571

( * ) Notice: Subject to any disclaimer, the term of this patent is extended or adjusted under 35 U.S.C. 154(b) by 0 days.

(21) Appl. No.: 10/204,730

(22) PCT Filed: Feb. 21, 2001

(86) PCT No.: PCT/RU01/00071

§ 371 (c)(1),
(2), (4) Date: Aug. 22, 2002

(87) PCT Pub. No.: WO01/65514

PCT Pub. Date: Sep. 7, 2001

(65) Prior Publication Data

US 2003/0020624 A1 Jan. 30, 2003

(30) Foreign Application Priority Data

Mar. 1, 2000 (RU) ..... 2000104950

(51) Int. Cl.[7] ..... G08B 1/00

(52) U.S. Cl. ..... 340/309.15; 340/309.4; 340/686.1; 340/692; 340/384.71

(58) Field of Search ..... 340/309.15, 309.3, 340/309.4, 309.6, 686.1, 687, 689, 692, 686.2, 384.71

(56) References Cited

U.S. PATENT DOCUMENTS 4,847,597 A * 7/1989 Dobosi ..... 34/571
5,841,356 A * 11/1998 Woodruff ..... 340/635
6,003,558 A * 12/1999 Neto et al. ..... 12/99
6,133,842 A * 10/2000 Gariepy ..... 340/689

* cited by examiner

*Primary Examiner*—Julie Lieu

(57) ABSTRACT

A signaling cap device comprises an audible message reproducing unit, a switch, a power supply, and a former of an audible message number, whereas the audible message reproducing unit is operative upon removal of the cap to reproduce one of N audible messages recorded therein depending on the message number.

4 Claims, 8 Drawing Sheets

CAP-SIGNALING DEVICE

BACKGROUND OF THE INVENTION

U.S. Pat. No. 5,625,347 to MacLean et al, 1997, discloses an electronic bottle cap comprising a housing that includes a power supply, an audible message reproducing means connected to a speaker, and a switch for closing a circuit upon removal of the cap from the bottle.

The device according to MacLean reproduces a prerecorded audible message right after the cap is removed from the vessel.

The drawback of the above device is the delivery of only one audible message. Besides, there is no possibility to set a time interval after removal of the cap from the vessel, at the end of which a message is delivered. The device according to MacLean does not provide a possibility to connect an audible message to the time of the day and to the length of the time interval after the previous cap closing.

U.S. Pat. No. 5,815,586 to Dobbins, 1998, discloses a sound signaling cap comprising a housing with a power supply, an audible message reproducing means connected to a speaker, and a switch for closing a circuit upon removal of the cap from the bottle.

The device according to the patent above reproduces a prerecorded audible message right after the cap is removed from the vessel.

The device described above also has its limitations. It cannot reproduce different audible messages on each removal of the cap from the vessel, each time the same audible message is delivered. Besides, there is no possibility to set a time interval after removal of the cap from the vessel, at the end of which a message is delivered. Also, the device does not provide a possibility to connect an audible message to the time of the day and to the length of the time interval after the previous cap closing.

U.S. Pat. No. 4,847,597 to Dobosi et al., 1989, U.S. Pat. No. 5,841,356 to Woodruff, et al., 1998, U.S. Pat. No. 6,144,842 to Gariepy, 2000, disclose devices in the form of a medicine bottle, containers or appliances having alarm devices or alarm systems that reproduce sound signals upon opening caps of such device. The limitation of all these devices is that it can reproduce only one type of a sound signal upon each opening of the cap.

OBJECTS AND SUMMARY OF THE INVENTION

It is an object of the present invention to provide a signaling cap able to reproduce new audible messages upon each removal of the cap from the vessel.

Another object of the present invention is to provide a cap with the possibility to set a length of the time interval after the removal of the cap from the vessel, at the end of which the next audible message is reproduced.

Another object of the present invention is to provide a connection of a reproduced audible message with the time of the day and the length of the time interval that passed after the previous opening of the cap.

These and other objects of the present invention are achieved in the cap the description of which is given below.

The signaling cap according to the present invention comprises displaced in its housing an audible message reproducing unit connected to a speaker and to a power supply, a switch for locking the electric circuit upon the cap removal, and a former of an audible message number displaced in the housing. Audible message reproducing unit is operative to reproduce one of N audible messages recorded therein in accordance with an audible message number. The audible message reproducing unit is attached to the former of an audible message number. The power supply is connected to the audible message reproducing means and to the former of an audible message number via the switch.

Further, the signaling cap according to the present invention can be equipped by a timer displaced in the housing and operative upon voltage supply to form an interval of time with a length depending on an audible message number. The timer is connected to the audible message reproducing unit, to the former of an audible message number, and via the switch to the power supply.

Further, the signaling cap is equipped with an electronic clock displaced in its housing and connected to the power supply and to the former of an audible message number.

Further, the signaling cap according to the present invention is equipped by an additional timer displaced in its housing and connected to the former of an audible message number and to the power supply via the switch.

The introduction of the former of an audible message number with corresponding connections and the specificities of the audible message reproducing unit provide the delivery of a new audible message upon each successive cap removal from the vessel, because each time the power is supplied to the former of an audible message number it produces a new message number.

The introduction of the timer with corresponding connections provides the possibility to set a length of the pause before each message is delivered. Further, the introduction of the electronic clock or the introduction of the additional timer with corresponding connections provides a possibility to select a message for reproduction depending on the time of the day or on the time passed after the previous cap opening.

BRIEF DESCRIPTION OF THE DRAWINGS

Further the invention will be illustrated by the accompanying drawings.

THE PREFERRED EMBODIMENT OF THE INVENTION

Figure 1:
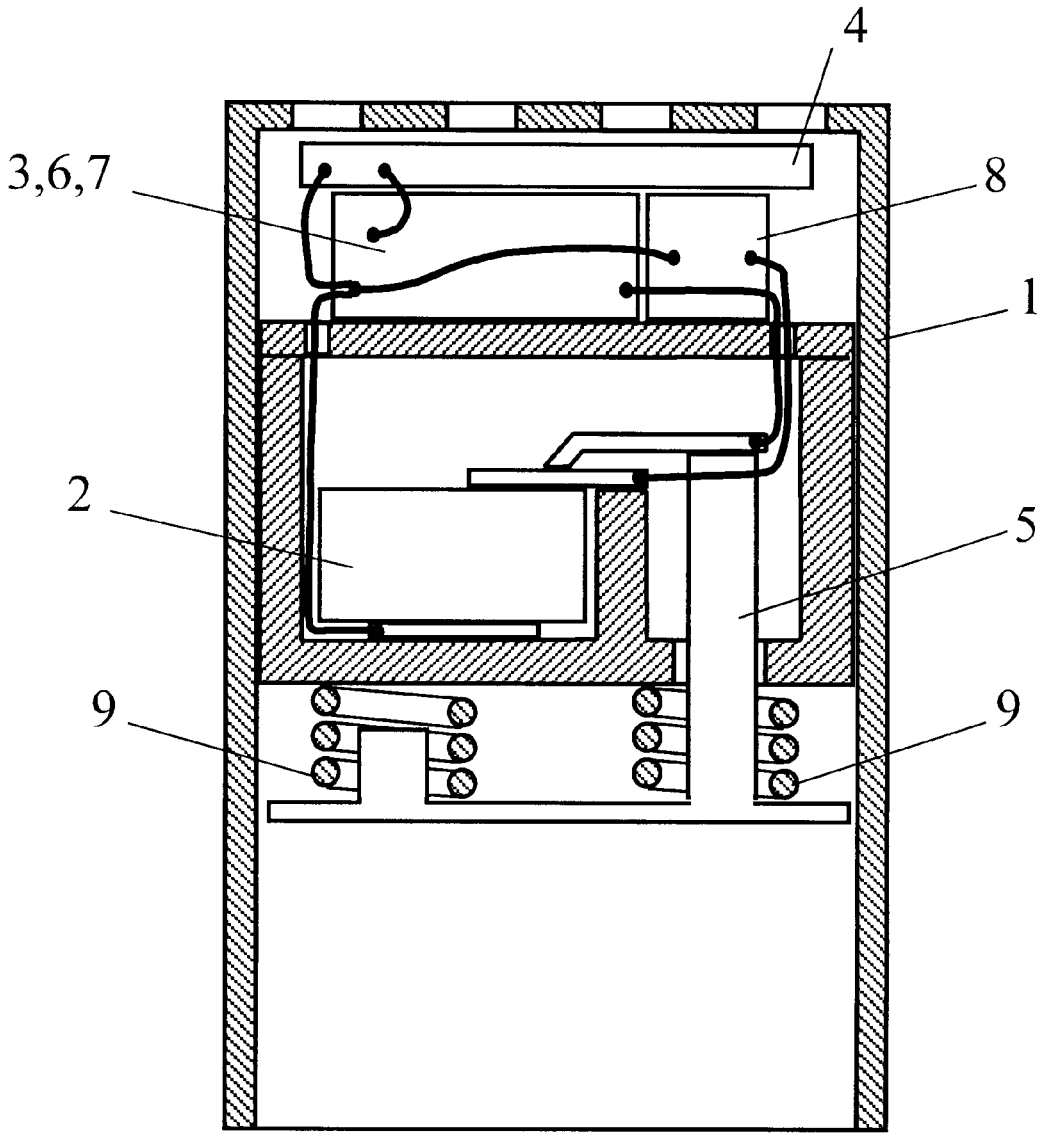
FIG. 1 shows the construction of the signaling cap.

The signaling cap (FIG. 1 and FIG. 2) comprises housing 1 with power supply 2, audible message reproducing unit 3 connected to speaker 4, and switch 5.

Besides, the device comprises former of an audible message number 6, the output of which is connected to a control input of audible message reproducing unit 3.

The first bus of power supply 2 is connected to the first supply inputs of audible message reproducing unit 3 and former of an audible message number 6. The first input of switch 5 is connected to the second bus of power supply 2, and the second input is connected to second supply inputs of audible message reproducing unit 3 and former of an audible message number 6.

Audible message reproducing unit 3 is operative to deliver one of N, where N is a whole number, audible messages recorded therein depending on the number of the message on its control input. Switch 5 is locked when the cap is not on the vessel, and open when the cap is on the vessel, after it is screwed on it. (The thread is not shown.) Former of an audible message number 6 is operative to produce a new message number on its output at each successive power supply.

Further, the signaling cap can comprise timer 7, the first output of which is connected to the first bus of power supply 2, the second output is connected to the second input of switch 5, the control input is connected to the output of former an audible message number 6, and the output connected to an additional control input of audible message reproducing unit 3.

Timer 7 is displaced in housing 1 and is operative in response to the supplying of power to form a time interval with a length depending- on a message number on its control input.

Further, the signaling cap can comprise electronic clock 8, the first and second supply inputs of which are connected to the first and second buses of power supply 2, and the output is connected to the control input of former of an audible message number 6.

In the preferred embodiment of the invention (FIG. 1), the device comprises springs 9 that provide the locking of switch 5 when the cap is off. Another variant of implementing switch 5 are also possible. For example, a hermetically sealed contact can be used. Housing 1 has a thread on the lower part of its inside surface (not shown in FIG. 1), that holds the cap on the vessel. Former of an audible message number 6 and timer 7 can be constructively combined with audible message reproducing unit 3.

Figure 3:
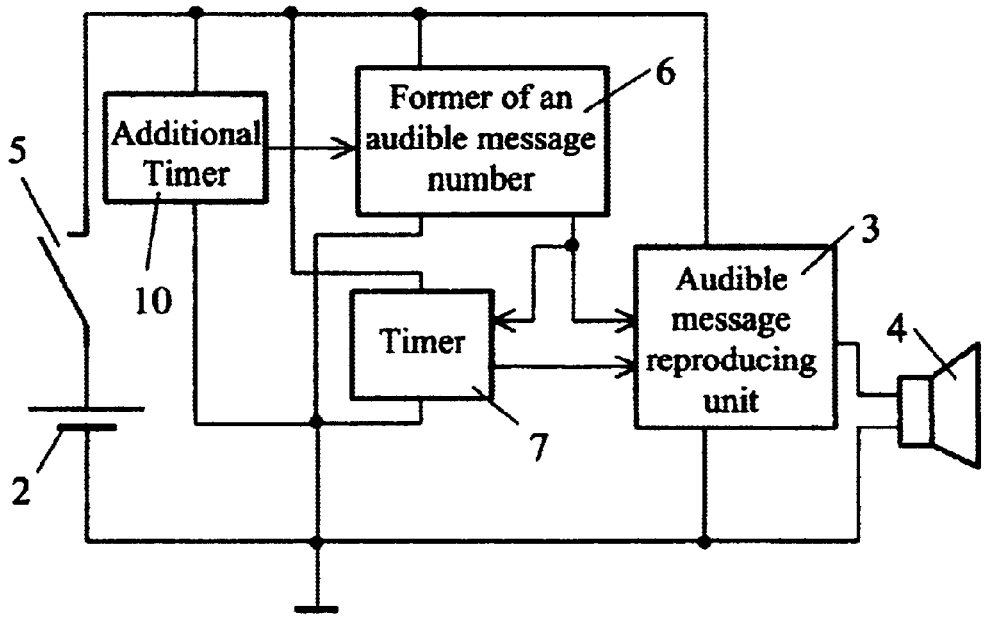
FIG. 3 shows another variant of an electrical structural circuit of the signaling cap.

Another variant of the device structure (FIG. 3) comprises displaced in housing 1 power supply 2, audible message reproducing unit 3 connected to speaker 4, switch 5, former of audible message number 6, the output of which is connected to the control input of audible message reproducing unit 3, timer 7, and additional timer 10.

The first bus of power supply 2 is connected to the first supply inputs of audible message reproducing unit 3, former of an audible message number 6, timer 7, and additional timer 10, and their second inputs are connected to the second input of switch 5, the first input of which is connected to the second bus of power supply 2. The control input of timer 7 is connected to the supply inputs of former of an audible message number 6, and the output is connected to an additional control input of audible message reproducing unit 3. The output of additional timer 10 is connected to control input of former of an audible message number 6.

Audible message reproducing unit 3 (FIG. 4) comprises microprocessor 11 with embedded program memory 12 connected to message memory 13 and digital-analog converter (DAC) 14, the output of which is connected to the input of amplifier 15, the output of which is the output of audible message reproducing unit 3.

Ground inputs of microprocessor 11, messages memory 13, DAC 14, and amplifier 15 form a first supply input of audible message reproducing unit 3. Supply inputs of microprocessor 11, message memory 13, DAC 14, and amplifier 15 form the second supply input of audible message reproducing unit 3 (not shown in FIG. 4). Microprocessor 11 can also function as timer 7. In such a case, the ground input of microprocessor 11 is the first supply input of timer 7, and supply input of microprocessor 11 is the second supply input of timer 7.

The corresponding subroutines flowcharts will be considered further.

In the device according to the present invention, microprocessor 11 can be implemented as for example microprocessor AT89C52 by Atmel Inc., having an embedded nonvolatile program memory 12 of 8 Kbyte. For connection with message memory 13 and DAC 14 certain bits of its input/output ports are used. Other bits of input/output ports form a control input of audible message reproducing unit 3.

Figure 4:
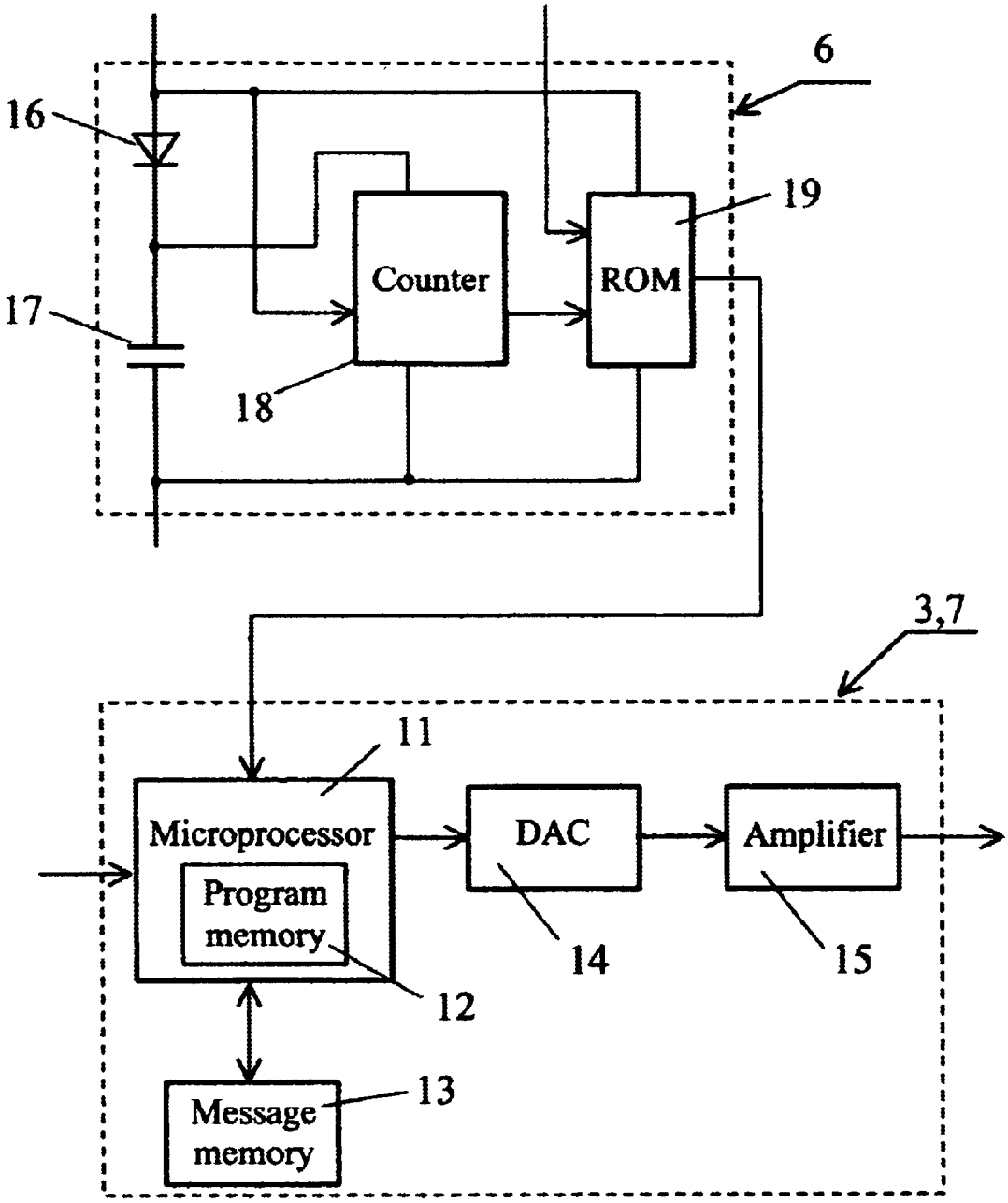
FIG. 4 shows an example of implementing an audible message reproducing unit and a former of an audible message number.

As shown in FIG. 4, in the variant under consideration former of an audible message number 6 comprises diode 16, capacitor 17, counter 18, read-only memory (ROM) 19. The ground inputs of counter 18 and ROM 19 are connected to the first pin of capacitor 17 and form the first supply input of former of an audible message number 6. The supply voltage input of ROM 19 is connected to anode of diode 16 and counting input of counter 18 and forms the second supply input of former of an audible message number 6. The cathode of diode 16 is connected to the second pin of capacitor 17 and to the supply voltage input of counter 18, the output of which is connected to the first input of ROM 19, the second input and output of which are the control input and output of former of an audible message number 6 accordingly. ROM 19 comprises prerecorded message numbers, and its first and second inputs are groups of address bits. Counter 18 is implemented on an integrated circuit with a minimal power consumption. The increase of counter 18 content by 1 takes place when the voltage on its counting input changes from 1 to 0. Capacitor 17 has the capacity enough for supplying counter 18 during a long period of time, for example, not less then for 24 hours.

It is possible to implement former of an audible message number 6 on the same microprocessor 11 as used in audible message reproducing unit 3. In this case, the functioning of former 6 is implemented as software. One or several bits of one of input/output ports of microprocessor 11 are the control input of former of an audible message number 6. The corresponding subroutines will be considered further.

Electronic clock 8 can comprise a clock pulse generator and a counter, the outputs of all or part of bits of which form the output of clock 8. In case of implementing of former 6 on microprocessor 11, clock 8 can be implemented as a special integrated circuit, for example DS1305E by Dallas Semiconductor Corp., which sends to microprocessor 11 current date and time in a digital format.

Figure 5:
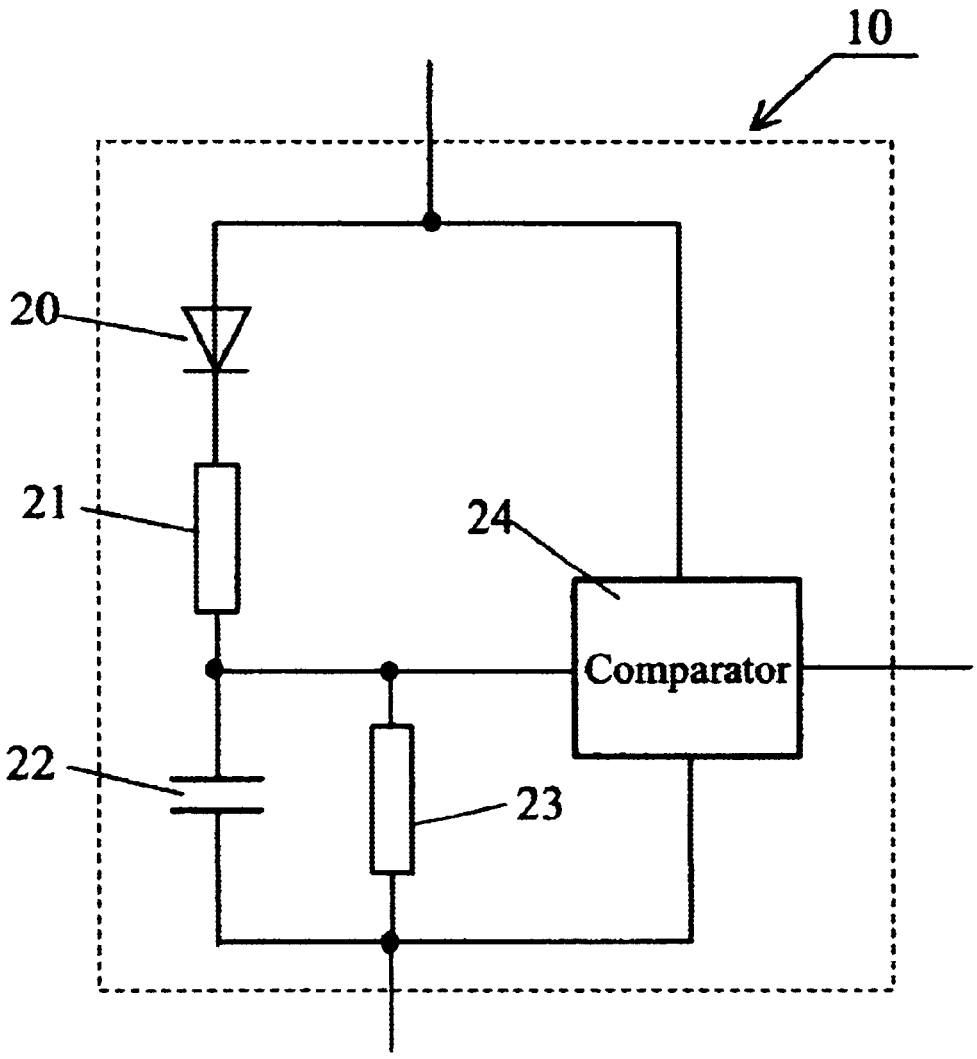
FIG. 5 shows an example of implementing an additional timer.

Additional timer 10 (FIG. 5) comprises diode 20, first resistor 21, capacitor 22, second resistor 23, and comparator 24. The anode of diode 20 is connected to the supply voltage input of comparator 24, which is the second supply input for additional timer 10. The cathode of diode 20 through first resistor 21 is connected to the first pin of capacitor 22, to the first pin of second resistor 23, and input of comparator 24, the output of which is an output of the additional timer 10. The second pin of capacitor 22, the second pin of second resistor 23 and the ground inputs of comparator 24 form the first supply input of additional timer 10. In housing 1 (FIG. 1) additional timer 10 can be positioned instead of electronic clock 8.

Message memory 13 can be a non-volatile electric erasable memory, for example AT45D161 by Atmel Inc. Messages delivered by the device are prerecorded in message memory 13. This is done with the use of special equipment and software. These tools are widely known in the art and are not described in the present application. After messages and all other necessary information are recorded into message memory 13, it is installed in the device according to the present invention.

Figure 6:
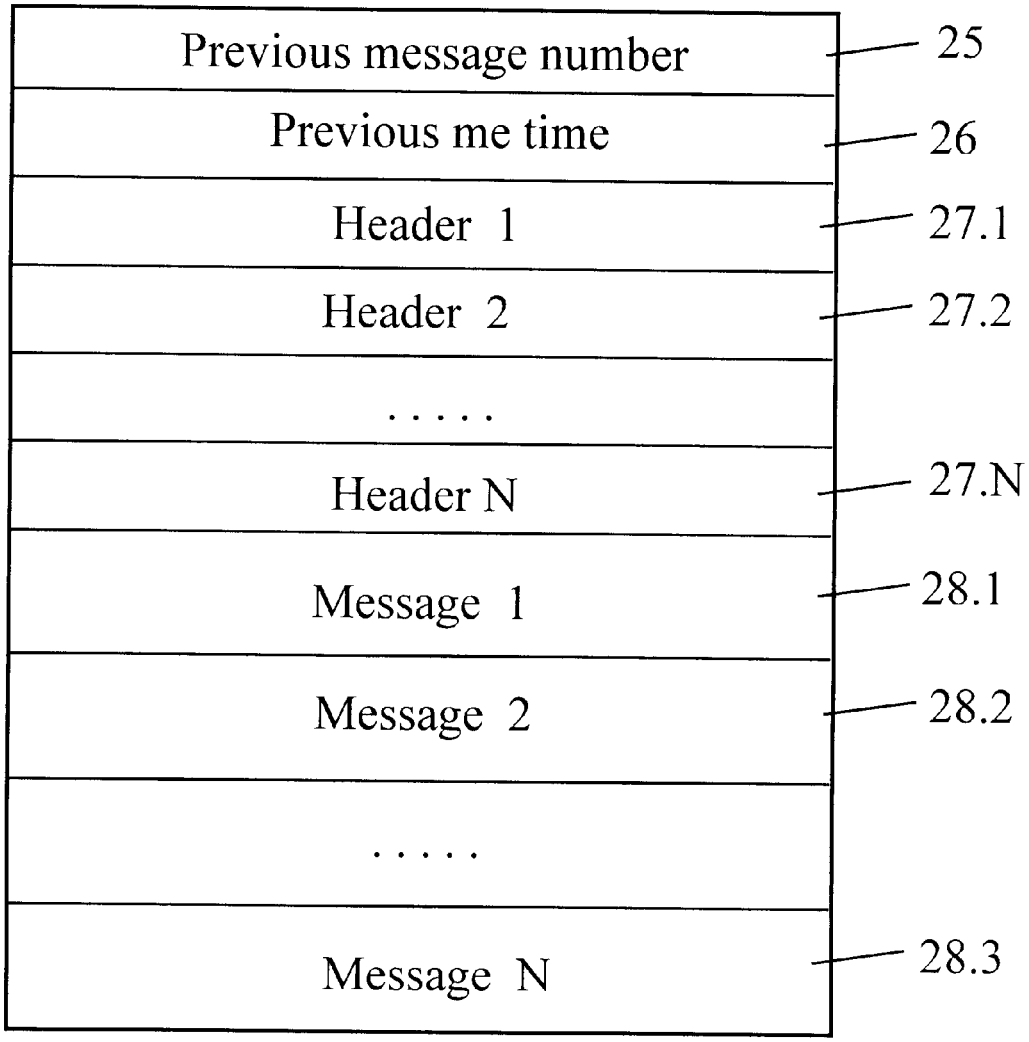
FIG. 6 shows a data structure in the message memory.

Message memory 13 comprises several data fields (FIG. 6). Contents of some of them can change during the device operation. All information in message memory 13 is saved when the power supply is cut off.

Field 25 stores the number of a previously reproduced message further denoted as Npr. Npr is stored as a whole number taking magnitudes from 0 to N, wherein N is a full number of messages recorded in the device. Before the device operation, this field comprises a zero. Field 26 stores the time and date of the last previously reproduced message. This data is further denoted as TDpr. An exact format for recording TDpr data is not significant for disclosing of the device operation. Before the device operation, field 25 can comprise the time and date when data in message memory 13 was recorded. Fields 27.1 . . . 27.N store headers of messages from 1 to N. Each header comprises three whole numbers. The first number further denoted as Adr(I) (where I=1 . . . N is a message number), is an initial address of the given message in message memory 13. The second number further denoted as NB(I) shows the number of information bytes in the given message. The third number further denoted as DT(I) shows the length of the delay before the given message is reproduced. Fields 28.1 . . . 28.N store audible messages. Field 28.I begins with address Adr(I) and occupies NB(I) bytes in message memory 13. The format for recording a sound signal depends on the coding method of the sound information.

Figure 7:
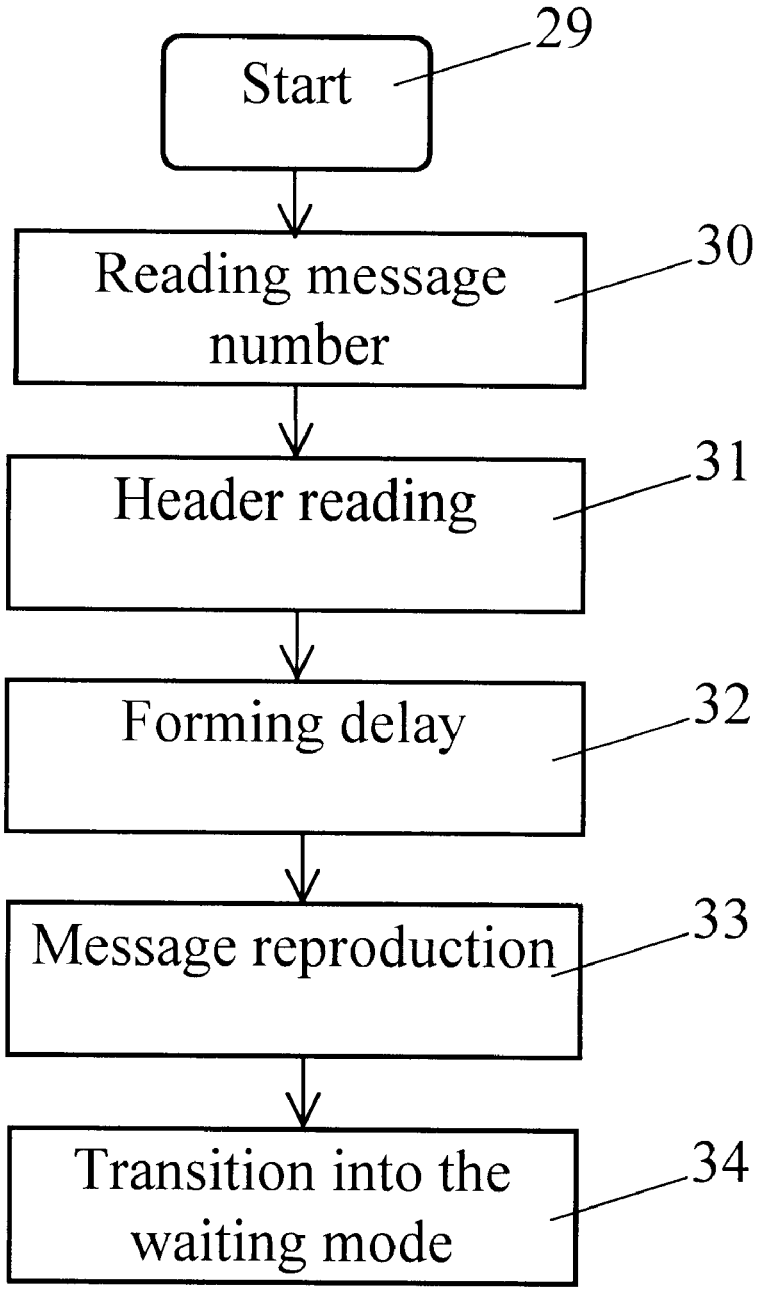
FIG. 7 shows a flowchart of the program executed by the microprocessor.
Figure 8:
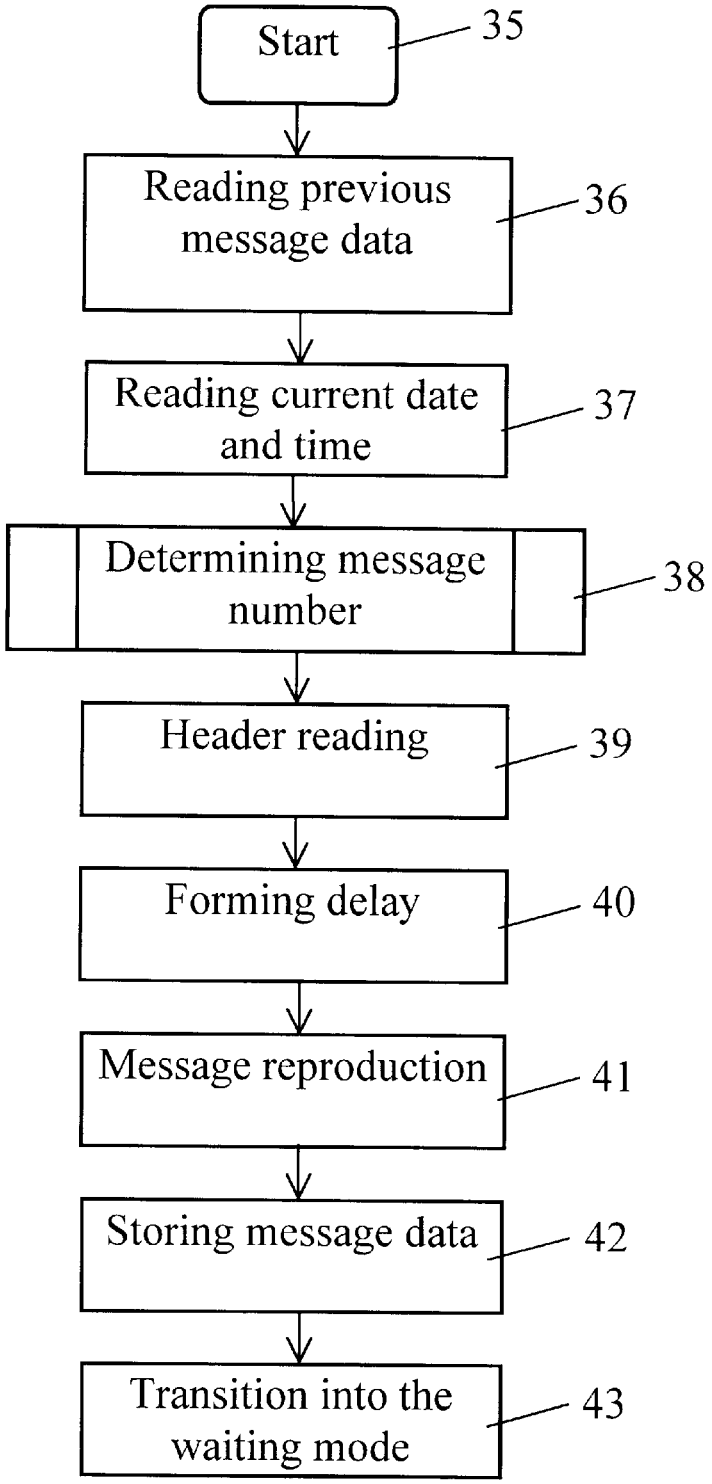
FIG. 8 shows a second variant of the flowchart of the program executed by the microprocessor.
Figure 9:
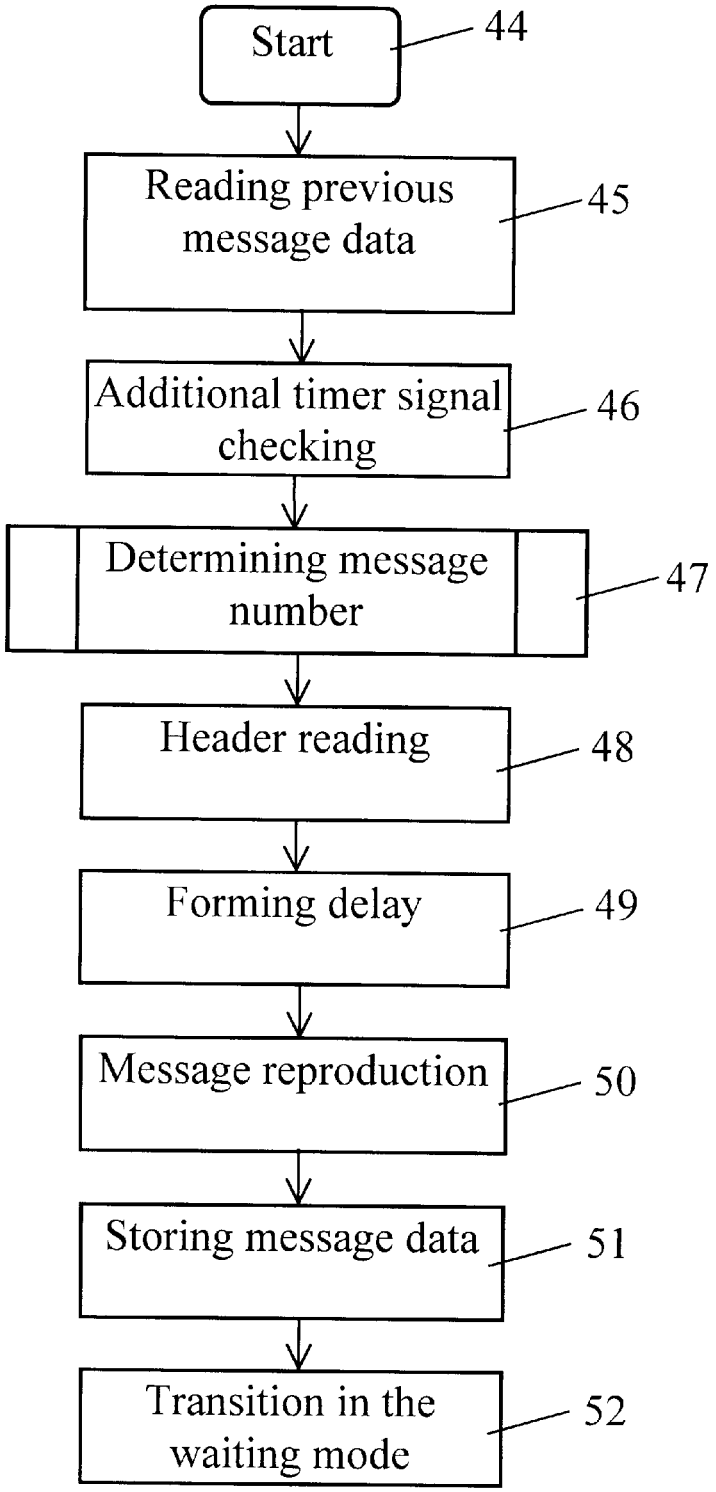
FIG. 9 shows a third variant of the flowchart of the program executed by the microprocessor.

The program recorded in program memory 12 comprises program blocks 29 . . . 34 (FIG. 7). Another variant of the program (FIG. 8) comprises program blocks 35 . . . 43. The third variant of the program (FIG. 9) comprises program blocks 44 . . . 52.

Operation of the Device

Figure 2:
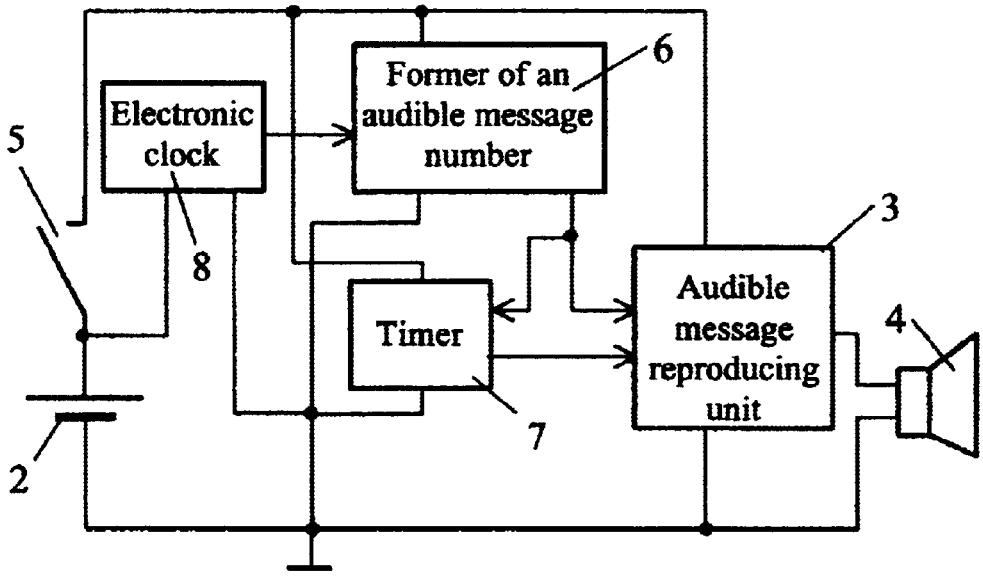
FIG. 2 shows an electrical structural circuit of the signaling cap.

When the cap cover the vessel, springs 9 are compressed and switch 5 is lifted so that the circuit is open (FIG. 2). The power from power supply 2 is not supplied to audible message reproducing unit 3 and former of an audible message number 6. If the device has electronic clock 8, the clock is constantly supplied by power and it continuously counts time.

When the cap is taken off the vessel, switch 5 goes down under the pressure of springs 9 and closes the circuit. The power from power supply 2 is supplied to audible message reproducing unit 3 and former of an audible message number 6.

When the cap is put back on the vessel, switch 5 is lifted up compressing spring 9 and opens the circuit. In former 6 (FIG. 4), the voltage on capacitor 17 is equal to zero till the first power switch-on. When the power is applied for the first time to former 6, capacitor 17 charges via diode 16, and the voltage is supplied to counter 18 set to a certain number M0. When the power is switched off, diode 16 locks, but capacitor 17 preserves voltage keeping counter 18 in a working mode. At the same time, the voltage on the counting input of counter 18 decreases to the level close to zero as a result of conductivity between first and second supply inputs of former 6, microprocessor 11, DAC 14, amplifier 15, and other elements. Thanks to this, the number recorded in counter 18 increases by a unit. If the following power switch-on occurs in a time interval not long enough for capacitor 17 to discharge, then the number recorded in counter 18 will be stored.

In the opposite case, counter 18 operation will begin with the initial state upon next power switch-on.

Upon the following power switch-on, this number increases by one more unit and so on. Each time the power is switched on, the code from the output of counter 18 arrives at the first input of ROM 19, setting the address from which a message number is read. This number is output from ROM 19 to the output of former 6 of an audible message number.

If the device does not have electronic clock 8 and additional timer 10, then all bits of the second input of ROM 19 can be connected to one of supply inputs of former 6. If the device has electronic clock 8, then the code arriving from said clock 8 is forwarded to the second input of ROM 19 and forms the second part of the address determining groups of messages reproduced at different times.

If the device has additional timer 10, then the second input of ROM 19 comprises one bit. In this case depending on the level of voltage on the output of additional timer 10 messages of one of the two groups are delivered. The operation of additional timer 10 will be described further. The operation of audible message reproducing unit 3 and of timer 7 are determined by the program recorded in program memory 12 and run by microprocessor 11.

Microprocessor 11 begins the execution of the program (FIG. 7) after the power is supplied to microprocessor 11 supply voltage input (program block 29).

Then microprocessor 11 reads a message number from the output of former of audible message number 6 (program block 30). Further, microprocessor 11 reads from field 27.1 of message memory 13 the header of the message with number I and retrieves from the header numbers Adr(I), NB(I), and DT(I) (program block 31). Then microprocessor 11 makes a delay for a time interval determined by number DT(I) (program block 32), executing the functions of timer 7. This operation can be executed for example by the way of repeating depending on DT(I) number of program loops with the known running time of each loop. If the executing of timer functions is not required, then block 32 can be excluded from the program. Then microprocessor 11 delivers an audible message (program block 33). The implementation of this subroutine depends on the coding method of sound information used. In all cases, microprocessor 11 consecutively reads data from message memory 13 beginning with Adr(I), converting this data into the numbers determining discrete magnitudes of a sound signal and in time intervals determined by sample frequency of a sound signal forwards said numbers to DAC 14. The analog signal received on the output of DAC 14 is amplified by amplifier 15 and is converted into sound waves in speaker 4. The reproduction of an audible message continues till all NB(I) bytes of the message information are read from message memory 13.

Finally, microprocessor 11 goes into the mode of a minimal power consumption from power supply 2 (program block 34). Microprocessor 11 remains in this state till the power is switched off upon putting the cap on the vessel. When the cap is taken off the vessel next time, the program is run from the beginning, but another audible message is delivered. It should be noted that in the preferred embodiment fields 25 and 26 in message memory 13 are not used and it is not required to change information recorded in message memory 13.

Further the description proceeds with the description of the device operation when former of an audible message number 6 is implemented with the help of microprocessor 11 used in audible message reproducing unit 3. After the power is switched on, microprocessor 11 runs a program recorded in program memory 12. Microprocessor 11 reads from message memory 13 and reproduces via DAC 14 and amplifier 15 a message the number of which changes upon each taking of the cap off the vessel. Before the delivery of each audible message, microprocessor 11 can make a delay for an interval of time determined by the message number. If the device comprises electronic clock 8, microprocessor 11 reads from it date, day of the week and time of the day and uses this data when choosing the number of a reproduced message.

Microprocessor 11 starts running the program (FIG. 8) after the power is supplied to a supply voltage input of microprocessor 11 (program block 35). Then microprocessor 11 reads from field 25 in message memory 13 number Npr of a previously reproduced message, and from field 26 in message memory 13—data TDpr about the date and time of the previous message reproduction (program block 36). Further, microprocessor 11 reads from electronic clock 8 data TDcur about the current time and date (program block 37). Said reading operation is executed in accordance with the technical data sheet of the used integrated circuit of electronic clock 8. After this microprocessor 11 runs subroutine 38 of determining message number I of an audible message on the basis of Npr, TDpr, and TDcur. Some variants of the algorithm for subroutine 38 will be further provided.

Then microprocessor 11 reads from field 27.I of message memory 13 the header of message with number I and retrieves from the read header numbers Adr(I), NB(I) H DT(I) (program block 39). Further, microprocessor 11 makes a delay for the interval of time determined by number DT(I) (program block 40) and reproduces an audible message (program block 41). The implementation of these steps was described before. Then microprocessor 11 stores in field 25 of message memory 13 number I of a reproduced message, and in field 26 of message memory 13—data TDcur about time and date when this message was reproduced (program block 42). Finally, microprocessor 11 goes into the mode of a minimal power consumption from power supply (program block 43). Microprocessor 11 remains in this mode till the power is switched off when the cap is put on the vessel. Upon the following removal of the cap the program is run from the beginning, but another message is delivered.

Subroutine 38 for determining a message number depends on the device functionality and can have many variants. The most simple variant is a successive reproduction of all messages recorded in message memory 13. When all N recorded messages are reproduced, after the following removal of the cap the message with number I=1 is delivered. Then other messages are consequently reproduced in increasing order of their numbers.

In another variant, subroutine 38 determines number I of the reproduced message using some well-know in the art algorithm for forming a random number in the interval from 1 till N. In this case, upon each removal of the cap one of recorded audible messages will be randomly reproduced.

It is possible for subroutine 38 to use data received from electronic clock 8. For example, the number of the message can be formed depending on the current time of the day. It is also possible to calculate an interval of time from the previous cap opening with the help of data TDpr and TDcur. In this variant, the reproduced message can be selected depending on the length of said interval. Message memory 13 can comprise voice messages, such as "One hour has passed", etc. If required, other more complicated algorithms can be used to select a message for reproduction.

In the other variant of structural circuit of the device (FIG. 3), switch 5 is open when the cap is on the vessel and the power is not supplied to audible message reproducing unit 3, former of an audible message number 6, and additional timer 10. When the cap according to the present invention is removed from the vessel, switch 5 under the influence of springs 9 goes down and locks the circuit. Capacitor 22 in additional timer 10 (FIG. 5) gets charged via diode 20 and first resistor 21 during some time interval T1 to the voltage approximately equal to the voltage of power supply 2.

When the cap is closed, switch 5 is open. Capacitor 22 begins to discharge via second resistor 23 and due to leakage currents of comparator 24 input and locked diode 20. Length T2 of capacitor 22 discharge from the initial to threshold voltage of comparator 24 is significantly higher than T1. T2 can be set by selecting capacity for capacitor 22, resistance for second resistor 23, and threshold voltage of comparator 24. Upon next opening of the cap, capacitor 22 charges again to the voltage approximately equal to the voltage of power supply 2.

Further the description will proceed with disclosing the device operation in case when former of an audible message number 6 is implemented on microprocessor 11. Microprocessor 11 starts running the program (FIG. 9) after the power is switched on (program block 44). Then microprocessor 11 reads from field 25 in message memory 13 number Npr of a previously reproduced message (program block 4.5). After this the level of the signal on the output of additional timer 10 is checked (program block 46). The result of said checking is further denoted as TT. The time taken by microprocessor 11 to execute program blocks 44, 45, and 46 is negligibly little compared to the charging time of capacitor 22 and consequently compared to time interval T1. That is why it can be said that at the moment of running program block 46 the voltage on capacitor 22 remained the same as at the moment of locking switch 5. If the time passed from the previous closing of the cap is less then T2, then the voltage on capacitor 22 at the moment of taking the cap off is more then threshold voltage of comparator 24 and variable TT is equal to logical 1. If the time passed from the moment of a previous cap closing is more then T2, then TT is equal to logical 0.

Then microprocessor 11 executes subroutine 47 of determining number I of an audible message on the basis of Npr and TT received before. For example, if TT is equal to logical 1, then a message can be selected warning that the cap is taken from the vessel before the planned time. In the opposite case, a message with the following number or with a random number can be selected.

Further microprocessor 11 reads from field 27.I of message memory 13 the header of the message with number I and retrieves from the read header numbers Adr(I), NB(I), and DT(I) (program block 48). Further microprocessor 11 makes a delay for an interval of time determined by DT(I) (program block 49), delivers an audible message (program block 50), and stores in field 25 of message memory 13 number I of the reproduced message (program block 51). Finally, microprocessor 11 goes into the mode of a minimal power consumption from power supply 2 (program block 52). On the following opening of the cap, the program is run from the beginning, but another message is delivered. Field 26 of message memory 13 is not used in this variant.

Conclusion, Ramifications and Scope

As it is clear from the description of the present invention, the invention provides a signaling cap device that has advantages over the devices known before. The device according to the present invention is operative to reproduce new audible messages upon each following taking of the cap off the vessel it is covering.

Another advantage of the device according to the present invention is the signaling cap device operative to set an interval from the moment it is taken from the vessel after which a following audible message is delivered.

Another advantage of the present invention device is the possibility to connect a reproduced audible message with the time of the day or with the length of the interval passed from the previous opening of the cap.

Although the description above contains many specifities, these should not be construed as limiting the scope of the invention but as merely providing illustrations of the presently preferred embodiment of this invention. Many other embodiments are possible. Some of these variants are discussed below.

The described device can be additionally supplied with other sensors known in the art. The outputs of such sensors should be connected to the corresponding inputs of microprocessor 11. For example, a sensor for liquid quantity control in a non-transparent vessel can be used. An additional sensor of illuminance can be used, for example for warning when a light-sensitive liquid is used. Also temperature and humidity sensors can be used. In these cases, the time of delivering audible messages reminding to close the cap can change depending on the temperature or humidity. An acceleration sensor can warn that some liquids should be handled with care.

The device according to the present invention can be used in production of packages for various medicine, where the signaling cap device makes it possible to provide the user with information about its intake, warn against overuse of drugs, and avoid an overdose due to forgetfulness of the user. The device according to the present invention can remind to close a vessel with an evaporating or harmful substance.

Another possible area of use of the device according to the present invention is as a souvenir or a promotional tool in caps for vessels with drinks or perfumes for example. Such cap would reproduce voice messages or music upon each removal from the vessel and thus promoting the products' commercial success.

Having described the preferred embodiments of the invention with the reference to the accompanying drawings, it is to be understood that the invention is not limited to this precise embodiment, and that various changes and modifications may be effective therein by one skilled in the art without departing from the scope or spirit of the invention as defined in the appended claims.

We claim:

1. A signaling cap device comprising displaced in its housing:

a power supply, a speaker, a switch operative to lock an electric circuit upon the removal of the cap, an audible message reproducing unit connected to said speaker and being operative to reproduce one out of N audible messages in accordance with an audible message number;

a former of an audible message number connected to said audible message reproducing unit, wherein said power supply is connected to said audible message reproducing unit and to said former of an audible message number via said switch.

2. The signaling cap device of claim 1 further comprising a timer displaced in said housing and connected to said audible message reproducing unit, to said former of an audible message number and via said switch to said power supply, wherein said timer is being operative upon voltage supply to form an interval of time with a length depending on an audible message number.

3. The signaling cap device of claim 1 further comprising an electronic clock, displaced in said housing and connected to said power supply and to said former of an audible message number.

4. The signaling cap device of claim 1 further comprising an additional timer displaced in said housing and connected to said former of an audible message number and via said switch to said power supply.

* * * * *